US010096304B2

(12) United States Patent
Kim

(10) Patent No.: US 10,096,304 B2
(45) Date of Patent: Oct. 9, 2018

(54) DISPLAY CONTROLLER FOR IMPROVING DISPLAY NOISE, SEMICONDUCTOR INTEGRATED CIRCUIT DEVICE INCLUDING THE SAME AND METHOD OF OPERATING THE DISPLAY CONTROLLER

(71) Applicant: Bo Young Kim, Hwaseong-si (KR)

(72) Inventor: Bo Young Kim, Hwaseong-si (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 275 days.

(21) Appl. No.: 15/003,057

(22) Filed: Jan. 21, 2016

(65) Prior Publication Data

US 2016/0217724 A1 Jul. 28, 2016

(30) Foreign Application Priority Data

Jan. 23, 2015 (KR) ..... 10-2015-0011492

(51) Int. Cl.
*G09G 5/395* (2006.01)

(52) U.S. Cl.
CPC ..... *G09G 5/395* (2013.01); *G09G 2300/0408* (2013.01); *G09G 2310/08* (2013.01); *G09G 2320/0242* (2013.01); *G09G 2320/0257* (2013.01); *G09G 2320/041* (2013.01)

(58) Field of Classification Search
CPC ..... G09G 2320/0257; G09G 2320/041; G09G 5/395
USPC ..... 345/690–697, 211–213
See application file for complete search history.

(56) References Cited

U.S. PATENT DOCUMENTS

| | | | | |
|---|---|---|---|---|
| 6,313,878 | B1 | 11/2001 | Jankowiak | |
| 7,965,315 | B2 | 6/2011 | Jang | |
| 2006/0007080 | A1 | 1/2006 | Yeh | |
| 2006/0187158 | A1 | 8/2006 | Wakabayashi et al. | |
| 2013/0257884 | A1 | 10/2013 | Koh | |
| 2016/0055787 | A1* | 2/2016 | Matsuyama ..... | G09G 3/344 345/691 |

FOREIGN PATENT DOCUMENTS

| | | | |
|---|---|---|---|
| JP | 2004325853 | A | 11/2004 |
| JP | 2008191588 | A | 8/2008 |
| KR | 10-0461462 | B1 | 12/2004 |
| KR | 20070062836 | A | 6/2007 |
| KR | 10-0847241 | B1 | 7/2008 |
| KR | 10-0919724 | | 9/2009 |

* cited by examiner

*Primary Examiner* — Michael Pervan
(74) *Attorney, Agent, or Firm* — Harness, Dickey & Pierce, P.L.C.

(57) ABSTRACT

Provided are a display controller for improving display noise, a semiconductor integrated circuit (IC) device including the same, and a method of operating the display controller. The display controller may include image processing logic configured to sequentially read a plurality of input image data via a data bus and process the plurality of input image data. The display controller may also include a timing generator configured to output a timing control signal. Further, the display controller may include a compensation image generator configured to generate and output a compensation image according to the timing control signal. The display controller may also include a data interface unit configured to transmit one of the compensation image and the plurality of input image data to the display device based on the timing control signal.

14 Claims, 11 Drawing Sheets

DISPLAY CONTROLLER FOR IMPROVING DISPLAY NOISE, SEMICONDUCTOR INTEGRATED CIRCUIT DEVICE INCLUDING THE SAME AND METHOD OF OPERATING THE DISPLAY CONTROLLER

CROSS-REFERENCE TO RELATED APPLICATION

This application claims the benefit of Korean Patent Application No. 10-2015-0011492, filed on Jan. 23, 2015 in the Korean Intellectual Property Office, the disclosure of which is incorporated herein in its entirety by reference.

BACKGROUND

One or more example embodiments of the inventive concepts relate to a display controller for improving display noise, a semiconductor integrated circuit (IC) device including the same, and/or method of operating the display controller, and more particularly, to a display controller for improving after-image noise of a display device, a semiconductor IC device including the same and/or method of operating the display controller.

Use of devices including high-resolution displays, e.g., smart phones, tablet personal computers (PCs), etc., has increased. In the devices, the quality of the display is very important. Thus, many attempts have been made to reduce display noise.

However, there still has been an after-image problem occurring when a specific type of an image is repeatedly displayed on a display. In general, a user uses a screen saver displaying an image that changes with time or artificially changes an image to solve the after-image problem. However, in this case, an additional operation may be performed according to a user's artificial setting or power consumption may increase due to an increase in the amount of image data to be transmitted.

SUMMARY

Example embodiments of the inventive concepts provide a display controller for improving display quality by reducing display noise (particularly, after-images), an integrated circuit (IC) apparatus including the same, and a method of operating the display controller.

According to example embodiments of the inventive concepts, there is provided a display controller for controlling a display device.

The display controller may include an image processing logic configured to sequentially read a plurality of input image data via a data bus, and process the plurality of input image data; a timing generator configured to output a timing control signal; a compensation image generator configured to generate and output a compensation image according to the timing control signal; and a data interface configured to transmit one of the compensation image and the plurality of input image data to the display device based on the timing control signal.

In one or more example embodiments, the display controller may further include a register configured to store a mode set signal and a compensation image transmission period, and the timing generator may output the timing control signal according to the mode set signal and the compensation image transmission period.

In one or more example embodiments, the timing generator may generate the timing control signal at a random point of time within the compensation image transmission period.

In one or more example embodiments, the display controller may further include an image comparator configured to determine whether same image data is repeatedly displayed a reference number of times or more from among the plurality of input image data.

In one or more example embodiments, the timing generator may output the timing control signal according to a result of determining by the image comparator whether the same image data is repeatedly displayed the reference number of times or more.

In one or more example embodiments, the reference number may be a desired number of frames or a desired time.

Each of the plurality of input image data may be frame data.

In one or more example embodiments, the image comparator may compare current frame data and previous frame data with each other to determine whether the current frame data and the previous frame data are the same image data.

In one or more example embodiments, the image comparator may compare an address of current frame data and an address of previous frame data with each other to determine whether the current frame data and the previous frame data are the same image data.

In one or more example embodiments, the display controller may further include a register configured to store a frame count enable signal and a frame skip rate, and the timing generator may include a frame counter configured to count a number of frames of the plurality of input image data and output the timing control signal if a result of counting the number of frames is equal to the frame skip rate in a state in which the frame count enable signal is enabled.

In one or more example embodiments, the timing generator may be enabled based on state information received from the display device.

According to other example embodiments of the inventive concepts, a semiconductor integrated circuit device includes a memory configured to store a plurality of input image data; a system bus; and a display controller connected to the memory via the system bus and configured to control a display device.

The display controller includes image processing logic configured to sequentially read the plurality of input image data from the memory via the system bus and process the plurality of input image data; a timing generator configured to generate a timing control signal when the same image data is repeatedly displayed a reference number of times or more among the plurality of input image data; a compensation image generator configured to generate and output a compensation image according to the timing control signal; and a data interface configured to transmit one of the compensation image and the plurality of the input image data to the display device based on the timing control signal.

In one or more example embodiments, the display controller may further include a register configured to store a mode set signal; and an image comparator configured to determine whether the same image data is repeatedly displayed the reference number of times or more among the plurality of input image data, and output to the timing generator a result based on whether the same image data is repeatedly displayed the reference number of times or more. The timing generator may output the timing control signal according to the mode set signal and whether the same image data is repeatedly displayed the reference number of times or more.

In one or more example embodiments, the register is configured to store a compensation image transmission period, and the timing generator may generate the timing control signal at a random point of time within the compensation image transmission period.

In one or more example embodiments, the display controller may further include decision logic configured to receive state information from the display device and set the mode set signal based on the state information.

According to other example embodiments of the inventive concepts, a method of operating a display controller that controls a display device includes reading frame data via a data bus; generating a timing control signal; generating a compensation image according to the timing control signal; and transmitting one of the compensation image and the read frame data based on the timing control signal to the display device.

According to other example embodiments of the inventive concepts, a method of operating a display controller that controls a display device includes generating a timing control signal; generating a compensation image rather than reading frame data based on the timing control signal; and transmitting the compensation image to the display device.

According to example embodiments of the inventive concepts a display controller of a display device may include a timing generator configured to output a control signal based on information from a register; a compensation image generator configured to output the compensation image based on the control signal; and a selector configured to select one of the compensation image and the plurality of frame data based on the control signal.

In one or more example embodiments, the selector is configured to select the plurality of frame data if the control signal is at a first logic value.

In one or more example embodiments, the selector is configured to select the compensation image if the control signal is at a second logic value, opposite from the first logic value.

In one or more example embodiments, the information includes a desired frame skip rate, and the timing generator includes a counter configured to count a number of frames of the plurality of frame data and output the control signal at the second logic value if the counted number of frames is equal to the desired frame skip rate.

In one or more example embodiments, a data interface configured to transmit the selected one of the compensation image and the plurality of frame data to the display device.

BRIEF DESCRIPTION OF THE DRAWINGS

Example embodiments of the inventive concepts will be more clearly understood from the following detailed description taken in conjunction with the accompanying drawings in which.

DETAILED DESCRIPTION OF THE EMBODIMENTS

Figure 1:
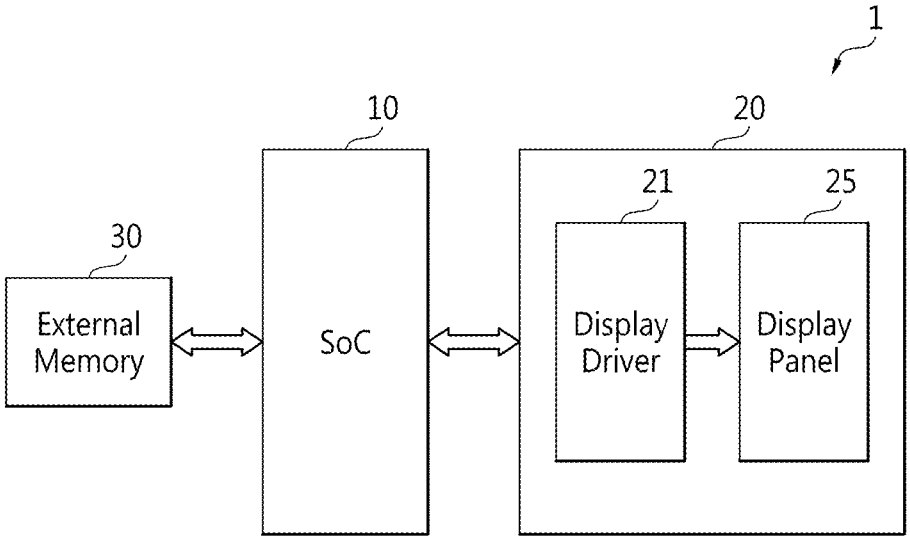
FIG. 1 is a block diagram of an electronic system including an integrated circuit (IC) device according to example embodiments of the inventive concepts.

Various example embodiments will now be described more fully with reference to the accompanying drawings in which some example embodiments are shown. However, specific structural and functional details disclosed herein are merely representative for purposes of describing example embodiments. Thus, the invention may be embodied in many alternate forms and should not be construed as limited to only example embodiments set forth herein. Therefore, it should be understood that there is no intent to limit example embodiments to the particular forms disclosed, but on the contrary, example embodiments are to cover all modifications, equivalents, and alternatives falling within the scope.

Although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments. As used herein, the term "and/or" includes any and all combinations of one or more of the associated listed items.

It will be understood that, if an element is referred to as being "connected" or "coupled" to another element, it can be directly connected, or coupled, to the other element or intervening elements may be present. In contrast, if an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," if used herein, specify the presence of stated features, integers, steps, operations, elements and/or components, but do not preclude the presence or addition of one or more other features, integers, steps, operations, elements, components and/or groups thereof.

Spatially relative terms (e.g., "beneath," "below," "lower," "above," "upper" and the like) may be used herein for ease of description to describe one element or a relationship between a feature and another element or feature as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, for example, the term "below" can encompass both an orientation that is above, as well as, below. The device may be otherwise oriented (rotated 90 degrees or viewed or referenced at other orientations) and the spatially relative descriptors used herein should be interpreted accordingly.

Example embodiments are described herein with reference to cross-sectional illustrations that are schematic illustrations of idealized embodiments (and intermediate structures). As such, variations from the shapes of the illustrations as a result, for example, of manufacturing techniques and/or tolerances, may be expected. Thus, example embodiments should not be construed as limited to the particular shapes of regions illustrated herein but may include deviations in shapes that result, for example, from manufacturing. For example, an implanted region illustrated as a rectangle may have rounded or curved features and/or a gradient (e.g., of implant concentration) at its edges rather than an abrupt change from an implanted region to a non-implanted region. Likewise, a buried region formed by implantation may result in some implantation in the region between the buried region and the surface through which the implantation may take place. Thus, the regions illustrated in the figures are schematic in nature and their shapes do not necessarily illustrate the actual shape of a region of a device and do not limit the scope.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 2:
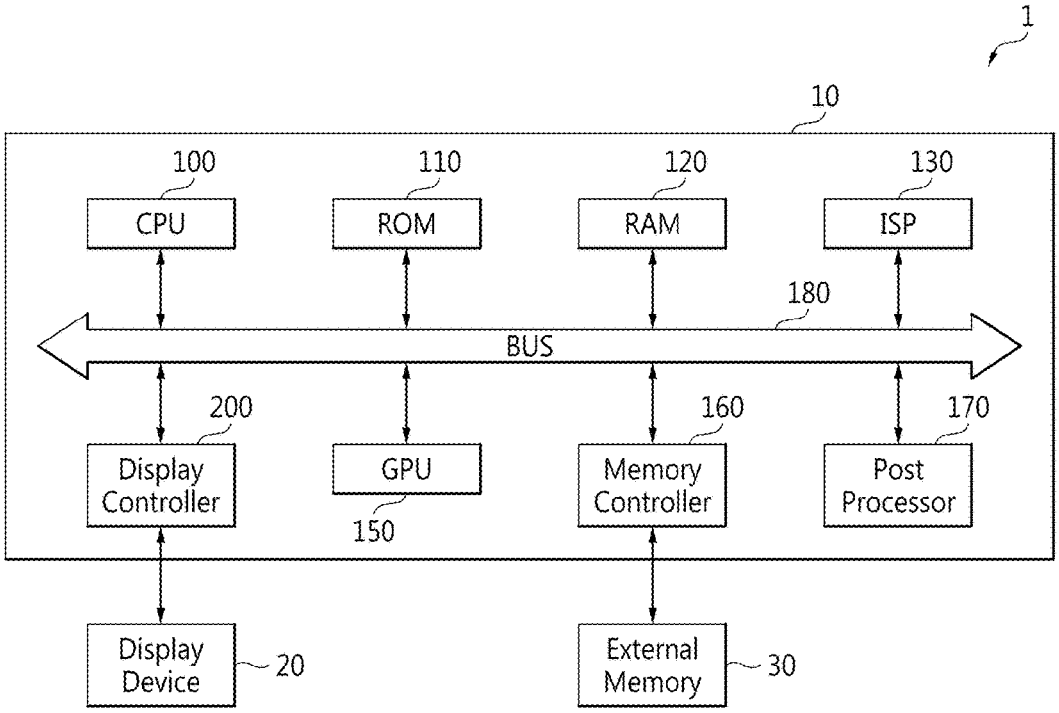
FIG. 2 is a block diagram of a system-on-chip (SoC) of FIG. 1 according to example embodiments of the inventive concepts.

FIG. 1 is a block diagram of an electronic system including an integrated circuit (IC) device according to example embodiments of the inventive concepts. The IC device may be embodied as a system-on-chip (SoC) or an application processor (AP). FIG. 2 is a block diagram of the SoC of FIG. 1 according to example embodiments of the inventive concepts.

Referring to FIGS. 1 and 2, an electronic system 1 may be embodied as a portable electronic device. The portable electronic device may be a laptop computer, a mobile phone, a smart phone, a tablet personal computer (PC), a personal digital assistant (PDA), an enterprise digital assistant (EDA), a digital still camera, a digital video camera, a portable multimedia player (PMP), a mobile internet device (MID), a wearable computer, an internet of things (IoT) device, an internet of everything (IoE) device, etc.

The electronic system 1 may display a still image signal (or a still image) or a video signal (or a video) on a display panel 25.

A display device 20 may include a display driver 21 and the display panel 25. In one or more example embodiments, a SoC 10 and the display driver 21 may be configured together as one module, one SoC, or one package (e.g., a multi-chip package). In other example embodiments, the display driver 21 and the display panel 25 may be configured together as one module.

The display driver 21 may control operations of the display panel 25 according to signals output from the SoC 10. For example, the display driver 21 may transmit image data received from the SoC 10 as an output image signal to the display panel 25 via a selected interface.

The display panel 25 may display the output image signal received from the display driver 21. For example, the display panel 25 may be embodied as a liquid crystal display (LCD), a light-emitting diode (LED) display, an organic LED (OLED) display, or an active-matrix OLED (AMOLED) display.

An external memory (or memory) 30 may store program instructions to be executed by the SoC 10. Also, the external memory 30 may store image data for displaying still images or a moving image on the display device 20. The moving image includes a series of different still images presented for a short time.

The external memory 30 may be a volatile memory or a nonvolatile memory. The volatile memory may be a dynamic random access memory (DRAM), a static RAM (SRAM), a thyristor RAM (T-RAM), a zero capacitor RAM (Z-RAM), or a twin transistor RAM (TTRAM). The nonvolatile memory may be an electrically erasable programmable read-only memory (EEPROM), a flash memory, a magnetic RAM (MRAM), a phase change RAM (PRAM), and/or a resistive memory.

The SoC 10 may control the external memory 30 and/or the display device 20. In one or more example embodiments, the SoC 10 may be also referred to as an IC, a processor, an application processor, a multimedia processor, and/or an integrated multimedia processor.

The SoC 10 may include a central processing unit (CPU) 100, a ROM 110, a RAM 120, an image signal processor (ISP) 130, a display controller 200, a graphics processing unit (GPU) 150, a memory controller 160, a post-processor 170, and a system bus 180. The SoC 10 may further include other components.

The CPU 100 which may be also referred to as a processor may process or execute programs and/or data stored in the external memory 30. For example, the CPU 100 may process or execute the programs and/or data according to an operating clock signal output from a clock signal module (not shown).

The CPU 100 may be embodied as a multi-core processor. The multi-core processor is one computing component having two or more independent and substantial processors (which are referred to as 'cores'). Each of these processors may read and execute program instructions.

The CPU 100 runs an operating system (OS). The OS may manage resources (e.g., a memory, a display, etc.) of the electronic system 1. The OS may distribute the resources to applications to be run in the electronic system 1.

Programs and/or data stored in the ROM 110, the RAM 120, and/or the external memory 30 may be loaded to a memory (not shown) of the CPU 100 if needed.

The ROM 110 may store permanent programs and/or data.

The ROM 110 may be embodied as an erasable programmable read-only memory (EPROM) or an electrically erasable programmable read-only memory (EEPROM).

The RAM 120 may temporarily store programs, data, or instructions. For example, programs and/or data stored in the ROM 110 or the external memory 30 may be temporarily stored in the RAM 120 under control of the CPU 100 or according to booting code stored in the ROM 110. The RAM 120 may be embodied as a DRAM or an SRAM, The ISP 130 may perform various processing on an image signal.

The ISP 130 may process image data that is input from an image sensor (not shown). For example, the ISP 130 may perform image stabilization and white balancing on image data that is input from the image sensor.

The ISP 130 may also perform color calibration such as brightness contrast, color balancing, quantization, color transformation into a different color space, etc. The ISP 130 may periodically store image-processed image data in the external memory 30 via the system bus 180.

The GPU 150 may read and execute program instructions related to graphics processing. For example, the GPU 150 may perform graphic processing related to graphics at a high speed.

Also, the GPU 150 may convert data read from the external memory 30 into a signal to be suitable for the display device 20 under control of the memory controller 160.

For graphic processing, not only the GPU 150 but also a graphic engine (not shown) or a graphic accelerator (not shown) may be used.

The post-processor 170 may perform post-processing on an image or an image signal to be suitable for an output device such as the display device 20. For example, the post-processor 170 may increase or decrease the size of an image or rotate the image so that the image may be adjusted to be suitable to be output to the display device 20.

The post-processor 170 may store the post-processed image data in the external memory 30 via the system bus 180 or directly output the post-processed image data to the display controller 200 via the system bus 180 in an on-the-fly manner.

The memory controller 160 may interface with the external memory 30. The memory controller 160 may control overall operations of the external memory 30, and may control exchange of data between a host (not shown) and the external memory 30. For example, the memory controller 160 may write data to or read data from the external memory 30 according to a request from the host. Here, the host may be a master device such as the CPU 100, the ISP 130, the GPU 150, or the display controller 200.

In one or more example embodiments, the memory controller 160 may read image data from the external memory 30 and provide the image data to the display controller 200 according to the request from the host to provide the image data, which is received from the display controller 200.

The display controller 200 may control an operation of the display device 20.

The display controller 200 may receive, via the system bus 180, the image data to be displayed on the display device 20, may convert the image data into a signal (e.g., a signal according to an interface standard) to be transmitted to the display device 20, and may transmit the signal to the display device 20.

In one or more example embodiments, the display controller 200 may request the memory controller 160 to provide frame data at preset time intervals, and receive image data in units of frames.

The components 100, 110, 120, 130, 150, 160, 170, and 200 may communicate with one another via the system bus 180. That is, the system bus 180 connects the components of the SoC 10 to one another, and functions as a path in which data is exchanged among the components. Also, the system bus 180 may function as a path in which a control signal is exchanged among the components.

Figure 3:
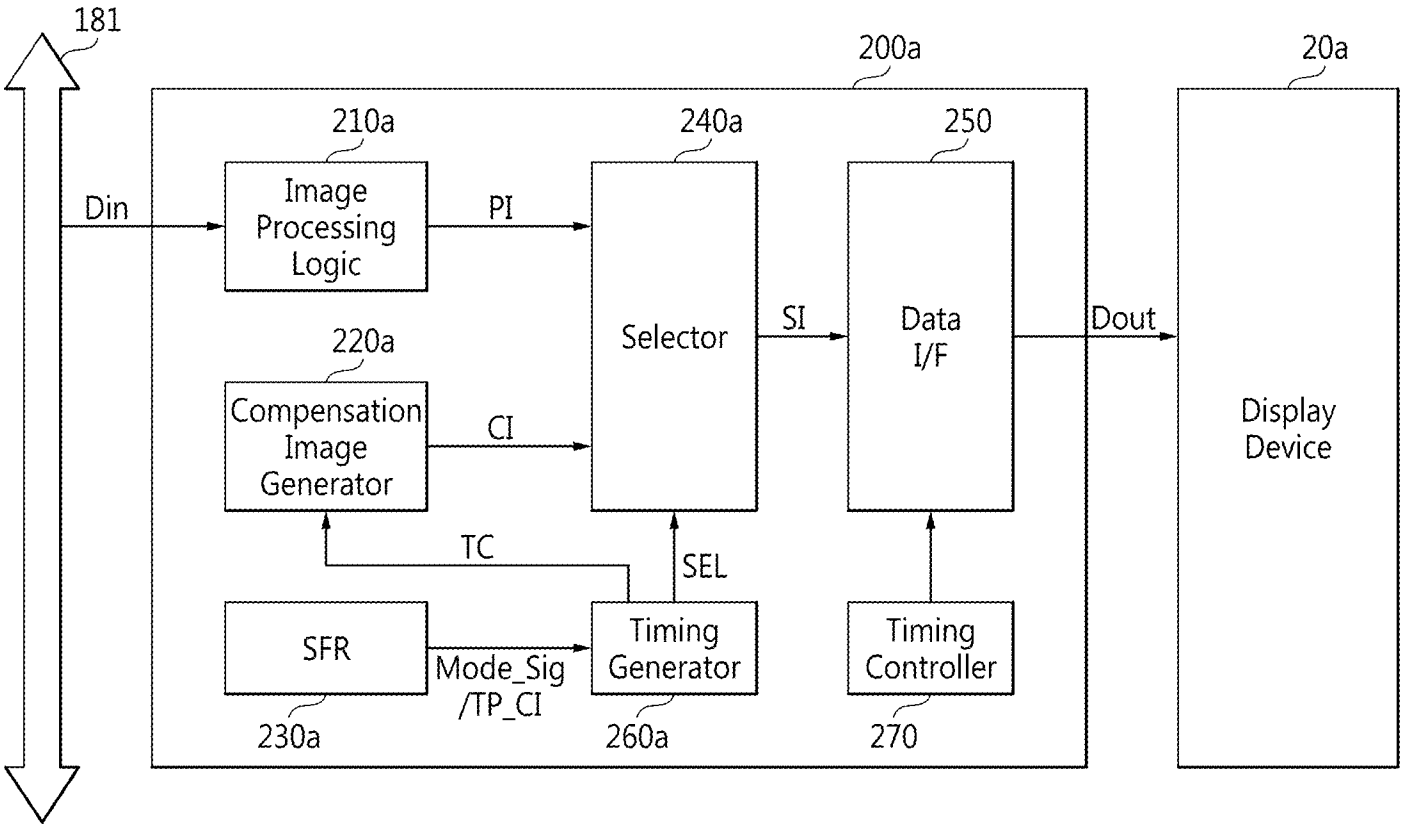
FIG. 3 is a block diagram of a display controller of FIG. 2 according to example embodiments of the inventive concepts.
Figure 5:
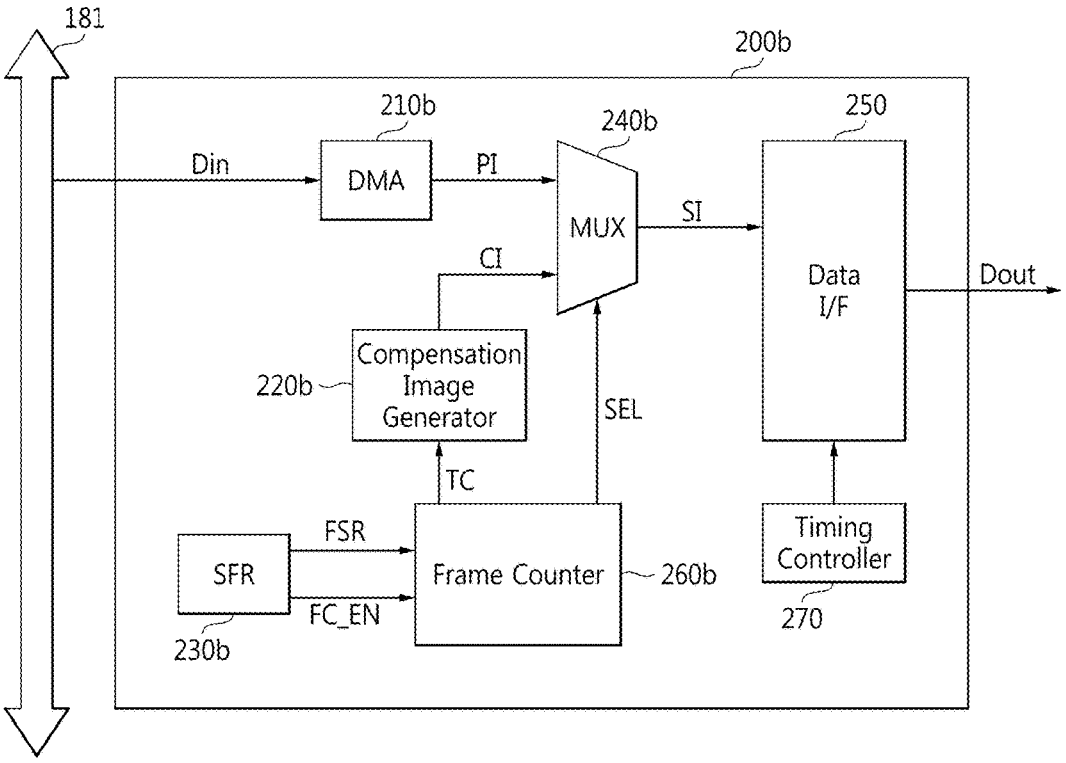
FIG. 5 is a block diagram of a display controller of FIG. 2 according to other example embodiments of the inventive concepts.

In one or more example embodiments, the system bus 180 may include a data bus 181, as shown in FIG. 3 and FIG. 5, configured to transmit data, an address bus (not shown) configured to transmit an address signal, and a control bus (not shown) configured to transmit a control signal, but is not limited thereto.

In one or more example embodiments, the system bus 180 may include a small-scale bus for establishing data communication between components, i.e., an interconnector.

FIG. 3 is a block diagram of a display controller of FIG. 2 according to example embodiments of the inventive concepts.

Referring to FIGS. 1 to 3, a display controller **200*a* according to example embodiments of the inventive concepts may include an image processing logic 210*a*, a compensation image generator 220*a*, a register (special function register (SFR)) 230*a*, a selector 240*a*, a data interface unit (I/F) 250, a timing generator 260*a*, and a timing controller 270**.

The image processing logic **210*a* may receive input image data Din from various sources via the data bus 181. For example, the image processing logic 210*a* may receive the input image data Din output from the CPU 100, the external memory 30, the GPU 150 or another component (not shown), such as a scaler, a post-processor, etc., via the data bus 181**.

To this end, the image processing logic **210*a* may include at least one direct memory access (DMA) unit 210*b* of FIG. 5 to access a memory and read the input image data Din from the memory. In one or more example embodiments, the input image data Din may be R, G, B data, and the image processing logic 210*a*** may read the input image data Din in units of frames.

The image processing logic **210*a*** may buffer and output the input image data Din, or process and output the input image data Din.

For example, in one or more example embodiments, the image processing logic **210*a*** may blend or combine input image data Din received from two or more DMA units, and output image data PI which is a result of blending or combining the input image data Din.

The compensation image generator **220*a*** may generate a compensation image CI. For example, the compensation image CI may be color image data, e.g., R, G, B data.

The compensation image CI is an image for reducing after-image noise that occurs when the same image is repeatedly displayed on the display device **20*a***.

In one or more example embodiments, the compensation image CI may be at least one of data that is set and stored beforehand, random data that is not related to the input image data Din, or complementary data that is complementary to the input image data Din.

For example, in one or more example embodiments, the compensation image generator 220*a* may output a compensation image having a specific color value, e.g., a white image, and generate the compensation image CI using data stored beforehand.

In one or more example embodiments, the compensation image generator 220*a* may generate random data that is not related to the input image data Din, and output the random data as the compensation image CI.

Also, the compensation image generator 220*a* may receive the input image data Din, invert the input image data Din to generate complementary data, and output the complementary data as the compensation image CI.

The timing generator 260*a* may control timing when the compensation image CI is to be generated.

For example, the timing generator 260*a* may output a timing control signal TC to the compensation image generator 220*a* at the timing when the compensation image CI is to be generated, and the compensation image generator 220*a* may generate the compensation image CI according to the timing control signal TC.

Also, when the compensation image CI is generated, the timing generator 260*a* may output a selection signal SEL to control the selector 240*a* to select the compensation image CI instead of the output image data PI output from the image processing logic 210*a*. The selection signal SEL may be the same as the timing control signal TC or may be generated based on the timing control signal TC by the timing generator 260*a*.

The selector 240*a* may select and output either the output image data PI output from the image processing logic 210*a* or the compensation image CI output from the compensation image generator 220*a*.

For example, the selector 240*a* may selectively output the output image PI or the compensation image CI according to the selection signal SEL output from the timing generator 260*a*.

In one or more example embodiments, the selector 240*a* may be embodied as a switch or a multiplexer but is not limited thereto.

The data interface 250 may receive a selection image SI from the selector 240*a*, and may transmit output image data Dout to the display device 20*a* based on the control of the timing controller 270.

The data interface 250 may transmit the output image data Dout to the display device 20*a* according to a desired (or, alternatively predetermined) interface standard, e.g., MIPI® (Mobile Industry Processor Interface).

Thus, the data interface 250 may convert the selection image SI to meet the desired (or, alternatively predetermined) interface standard.

Figure 4:
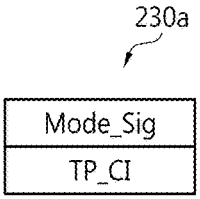
FIG. 4 is a diagram illustrating information stored in a register of FIG. 3 according to example embodiments of the inventive concepts.

The special function register 230*a* may store a mode set signal Mode_Sig as illustrated in FIG. 4. FIG. 4 is a diagram illustrating information stored in the special function register 230*a* of FIG. 3 according to example embodiments of the inventive concepts.

The mode set signal Mode_Sig is a signal representing whether a function of generating and transmitting a compensation image is enabled.

For example, in one or more example embodiments, when the mode set signal Mode_Sig is a first value, the timing generator 260*a* and the compensation image generator 220*a* are disabled and thus the compensation image CI is not generated. Thus, the data interface 250 does not transmit the compensation image CI to the display device 20*a*.

When the mode set signal Mode_Sig is a second value, the timing generator 260*a* and the compensation image generator 220*a* are enabled and thus the compensation image CI is generated. Thus, the data interface 250 may transmit the compensation image CI to the display device 20*a*.

The mode set signal Mode_Sig may be dynamically set according to a user's setting or based on desired (or, alternatively predetermined) information.

The special function register 230*a* may also store information regarding a compensation image transmission period TP_CI as illustrated in FIG. 4.

In one or more example embodiments, the timing generator 260*a* may control the compensation image CI to be transmitted once, on average, for each of compensation image transmission periods TP_CI.

For example, when the compensation image transmission period TP_CI is set to be 10 seconds, the timing generator 260*a* may generate the timing control signal TC to transmit the compensation image CI once, on average, every 10 seconds.

In this case, the timing generator 260*a* may generate the timing control signal TC at a point of time that is randomly determined within the compensation image transmission period TP_CI, e.g., within 10 seconds.

The point of time that the compensation image CI is to be generated may be randomly determined within the compensation image transmission period TP_CI, thereby minimizing degradation of the quality of an image.

In one or more example embodiments, a value of the special function register 230*a*, i.e., the mode set signal Mode_Sig, and the compensation image transmission period TP_CI may be set by a component outside the display controller 200*a*, e.g., the CPU 100 of FIG. 2.

In one or more example embodiments, when the compensation image CI is generated and transmitted, the image processing logic 210*a* may be controlled to not read new input image data Din.

For example, the timing generator 260*a* may output the timing control signal TC to the image processing logic 210*a* and the compensation image generator 220*a*.

Thus, the image processing logic 210*a* reads or does not read the input image data Din, e.g., new frame data, according to the timing control signal TC. As described above, new frame data is not read at a time when the compensation image CI is to be transmitted, thereby reducing power consumption, as will be described in detail with reference to embodiments of FIGS. 10 and 11 below.

FIG. 5 is a block diagram of a display controller of FIG. 2 according to other example embodiments of the inventive concepts.

A display controller 200*b* according to other example embodiments of the inventive concepts may include a DMA unit 210*b*, a compensation image generator 220*b*, a special function register 230*b*, a multiplexer 240*b*, a data interface unit 250, a frame counter 260*b*, and a timing controller 270.

The DMA unit 210*b*, the compensation image generator 220*b*, the special function register 230*b*, the multiplexer 240*b*, and the frame counter 260*b* may correspond to the image processing logic 210*a*, the compensation image generator 220*a*, the special function register 230*a*, the selector 240*a*, and the timing generator 260*a* of FIG. 3, respectively.

The DMA unit 210*b* receives input image data Din via a data bus 181. As described above with reference to FIG. 3, the input image data Din may be received from various sources.

The compensation image generator 220*b* may generate a compensation image CI. The compensation image CI may be color image data, e.g., R, G, B data, but is not limited thereto.

In one or more example embodiments, the compensation image generator 220*b* may output a compensation image having a specific color value, e.g., a white image, and output data that is stored beforehand as the compensation image CI.

In one or more example embodiments, the compensation image generator 220*b* may generate the compensation image CI from data that is stored beforehand. For example, the compensation image generator 220*b* may repeatedly output a data pattern having a desired (or, alternatively predetermined) length or repeatedly output data that is substantially the same as the data pattern and a result of inverting the output data, as the compensation image CI.

In one or more example embodiments, the compensation image generator 220*b* may generate random data that is not related to the input image data Din and output the random data as the compensation image CI.

Also, the compensation image generator 220*b* may receive the input image data Din, generate complementary data obtained by inverting the input image data Din, and output the complementary data as the compensation image CI.

The frame counter 260*b* may control timing when the compensation image CI is to be generated.

For example, the frame counter 260*b* may output a timing control signal TC to the compensation image generator 220*b* at a point of time that the compensation image CI is to be generated. The compensation image generator 220*b* may generate the compensation image CI according to the timing control signal TC.

The frame counter 260*b* may count the number of frames, and output the timing control signal TC to the compensation image generator 220*b* when a result of counting the number of frames is equal to a frame skip rate FSR output from the special function register 230*b*.

The frame counter 260*b* may be enabled in response to a frame count enable signal FC_EN output from the special function register 230*b*.

Thus, the frame counter 260*b* may count the number of frames and may control the compensation image CI to be generated when a result of counting the number of frames is equal to the frame skip rate FSR, only in a state in which the frame counter 260*b* is enabled according to the frame count enable signal FC_EN. Also, when the result of counting the number of frames is equal to the frame skip rate FSR, the frame counter 260*b* may be initialized, for example, to '0', and count the number of frames again.

Thus, a function of generating and transmitting a compensation image CI may be enabled or disabled according to the setting of the frame count enable signal FC_EN.

The frame count enable signal FC_EN may be dynamically set according to a user's setting or based on desired (or, alternatively predetermined) information. The frame count enable signal FC_EN and the frame skip rate FSR may be user defined and/or a design parameter based on empirical evidence.

In one or more example embodiments, a signal of the special function register 230*b*, i.e. the frame count enable signal FC_EN, and the frame skip rate FSR may be set by a component outside the display controller 200*b*, for example, the CPU 100 of FIG. 2.

The frame counter 260*b* may output a selection signal SEL to control the multiplexer 240*b* to select the compensation image CI instead of an output image PI output from the DMA 210*b*, when the compensation image CI is generated.

For example, the multiplexer 240*b* may select and output one of the output image PI output from the DMA 210*b* or the compensation image CI output from the compensation image generator 220*b* according to the selection signal SEL.

The data interface 250 may receive a selection image SI from the multiplexer 240*b*, and may transmit output image data Dout to the display device 20*a* based on the control of the timing controller 270.

The data interface 250 may transmit the output image data Dout to the display device 20*a* according to a desired (or, alternatively predetermined) interface standard, e.g., the MIPI® (Mobile Industry Processor Interface).

Thus, the data interface 250 may convert the selection image SI to meet the desired (or, alternatively predetermined) interface standard.

Figure 6:
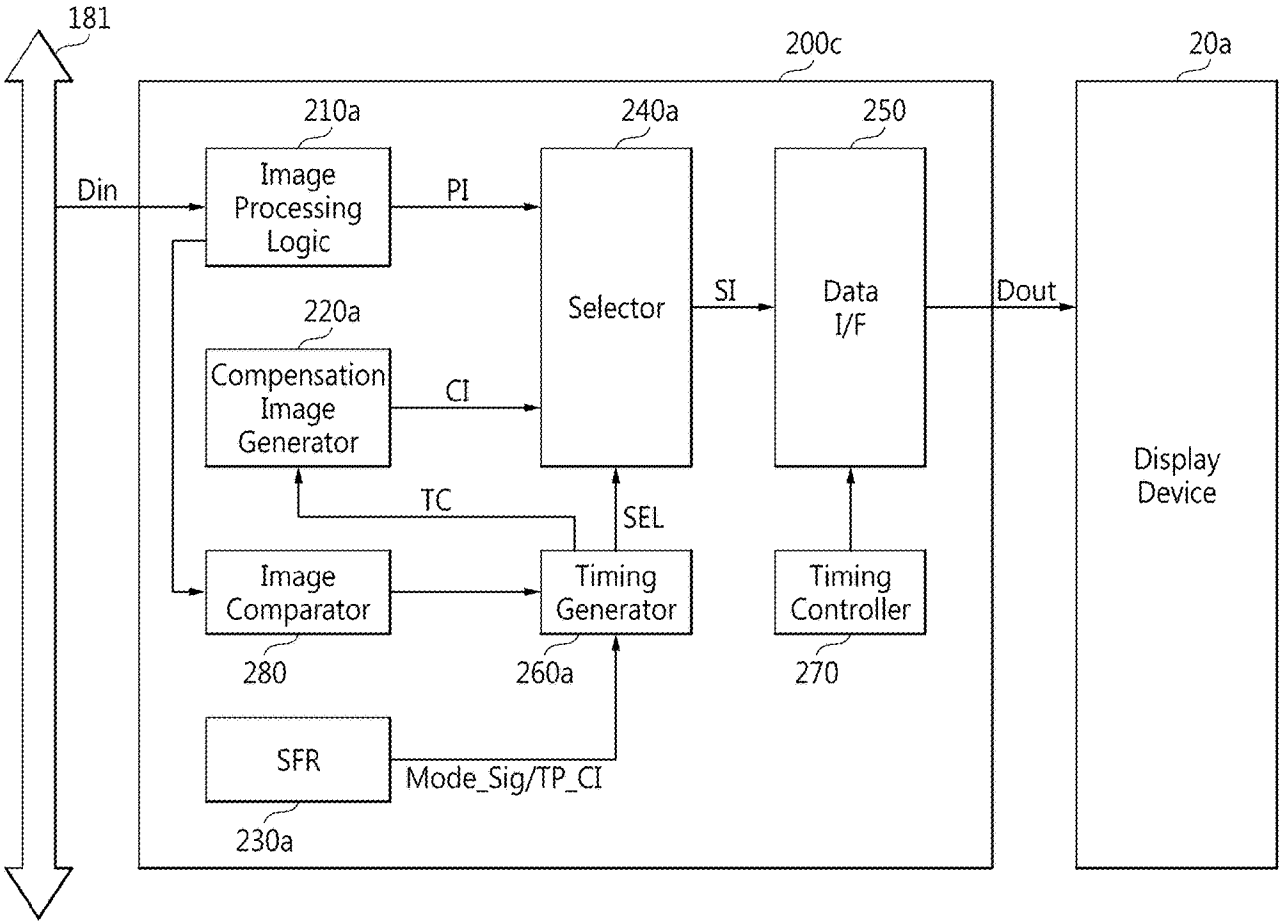
FIG. 6 is a block diagram of a display controller of FIG. 2 according to other example embodiment of the inventive concepts.

FIG. 6 is a block diagram of a display controller of FIG. 2 according to other example embodiments of the inventive concepts.

Referring to FIGS. 1 to 6, a display controller 200*c* of FIG. 6 according to other example embodiments of the inventive concepts is substantially the same as the display controller 200*a* of FIG. 3 in terms of their structures and operations and will be thus described focusing on the differences from the display controller 200*a*.

The display controller 200*c* of FIG. 6 according to other example embodiments of the inventive concepts may further include an image comparator 280, compared to the display controller 200*a* of FIG. 3.

The image comparator 280 may determine whether an image Din input to an image processing logic 210*a* is the same as a previous image or whether an image PI output from the image processing logic 210*a* is the same as the previous image.

The image comparator 280 may determine whether the same image is repeatedly displayed a reference number of times or more, and may provide the timing generator 260*a* with a result of determining whether the same image is repeatedly displayed the reference number of times or more.

Here, the expression "the same image" should not be understood to mean that a current frame and a previous frame are the same 100%, but may be understood to mean that both of the current and previous frames satisfy desired (or, alternatively preset) same conditions.

The expression "desired (or, alternatively preset same conditions" may be understood to mean that the current frame and the previous frame are identical to each other at a desired (or, alternatively predetermined) ratio (e.g., 60%, 70%, etc.) and/or that an address of the current frame (e.g., an address of a memory from which the current frame is read or an address of a DMA address) is identical to an address of the previous frame.

The expression "reference number" may be a time and/or the number of frames but is not limited thereto. The reference number may be user defined and/or a design parameter based on empirical evidence.

In one or more example embodiments, when it is determined that the same image is repeatedly displayed for a reference time or more or a reference number of frames or more, the image comparator 280 informs the timing generator 260*a* of the determination and the timing generator 260*a* may generate a timing control signal TC according to the determination of the image comparator 280.

In one or more example embodiments, the timing generator 260*a* may generate the timing control signal TC according to the mode set signal Mode_Sig of the special function register 230*a*, the compensation image transmission period TP_CI, and the determination of the image comparator 280. The mode set signal Mode_Sig and the compensation image transmission period TP_CI may be user defined and/or a design parameter based on empirical evidence For example, when the image comparator 280 determines that the same image is repeatedly displayed the reference number of times or more in a state in which the mode set signal Mode_Sig is set to a second value, the timing generator 260*a* may generate the timing control signal TC at a random point of time within the compensation image transmission period TP_CI.

Figure 7:
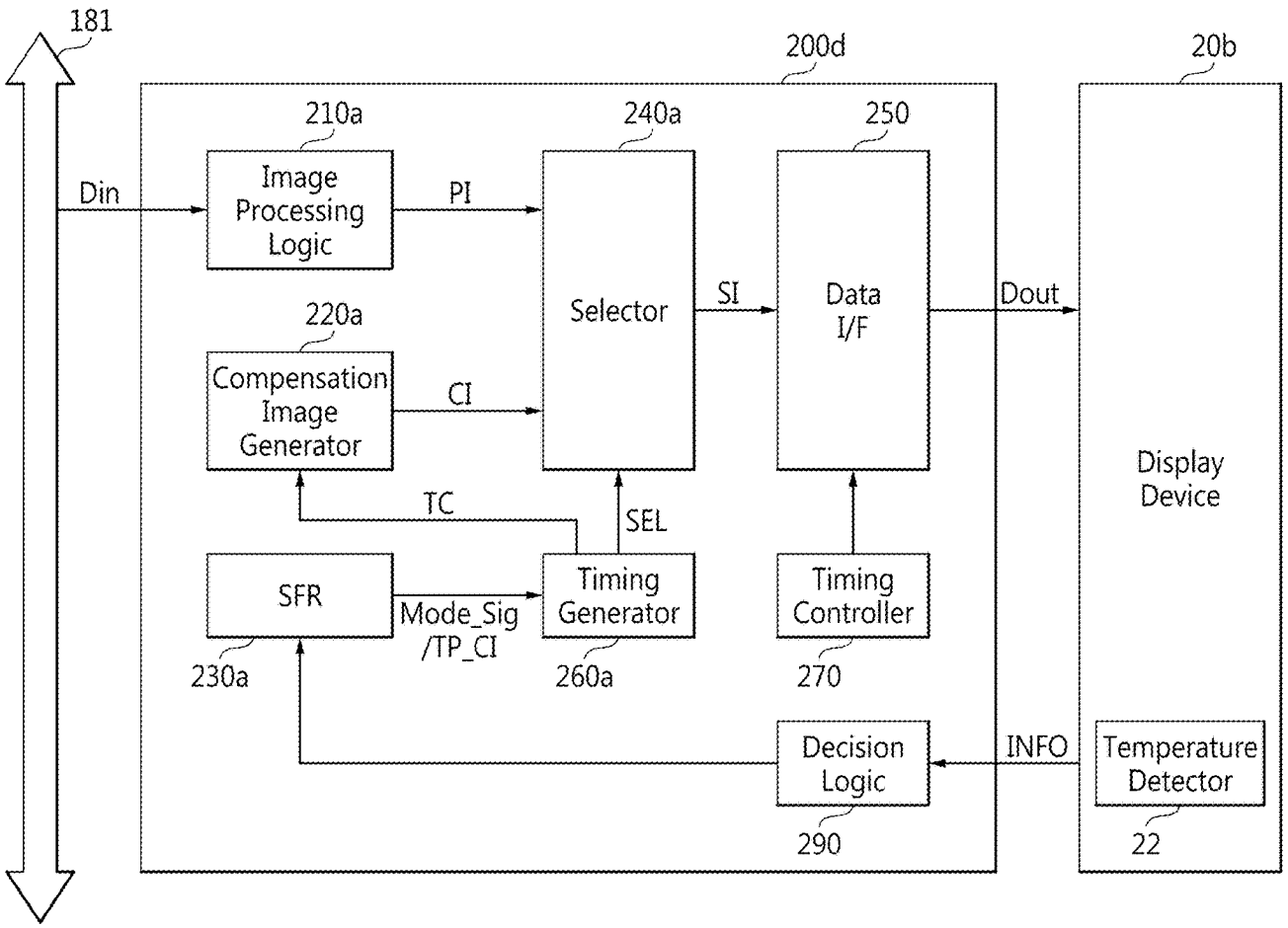
FIG. 7 is a block diagram of a display controller of FIG. 2 according to other example embodiments of the inventive concepts.

FIG. 7 is a block diagram of a display controller 200*d* such as that shown in FIG. 2 according to other example embodiments of the inventive concepts.

Referring to FIGS. 1 to 7, the display controller 200*d* of FIG. 7 according to other example embodiments of the inventive concepts is substantially the same as the display controller 200*a* of FIG. 3 in terms of their structures and operations and will be thus described focusing on the differences from the display controller 200*a*.

The display controller 200*d* of FIG. 7 according to other example embodiments of the inventive concepts may further include a decision logic 290, compared to the display controller 200*a* of FIG. 3.

A display device 20*b* of FIG. 7 further includes a temperature detector 22, compared to the display device 20*a* of FIG. 3.

The decision logic 290 may receive state information INFO from the display device 20*b*, and set a mode set signal Mode_Sig of a special function register 230*a*.

The state information INFO represents the states of the display device 20*b*, for example, temperature information (e.g., heat information), brightness information, etc. The state information INFO may include temperature information detected by the temperature detector 22 but is not limited thereto.

In one or more example embodiments, the display controller 200*d* may read the state information INFO of the display device 20*b* by using a specific command (e.g., a MIPI DSI command).

In one or more example embodiments, the display controller 200*d* may receive the state information INFO by polling specific signals of the display device 20*b*.

The decision logic 290 may set the mode set signal Mode_Sig to a second value when temperature information detected in the display device 20*b* is equal to or greater than a desired (or, alternatively predetermined) temperature.

As described above, the decision logic 290 may selectively enable a compensation image generator 220*a* and a timing generator 260*a* by setting the mode set signal Mode_Sig based on the state information INFO of the display device 20*b*.

In other example embodiments, the state information INFO may be information detected in a system including the display controller 200*d* (e.g., the system 1 of FIG. 1 or the SoC 10 of FIG. 2) other than information detected in the display device 20*b*.

Figure 8:
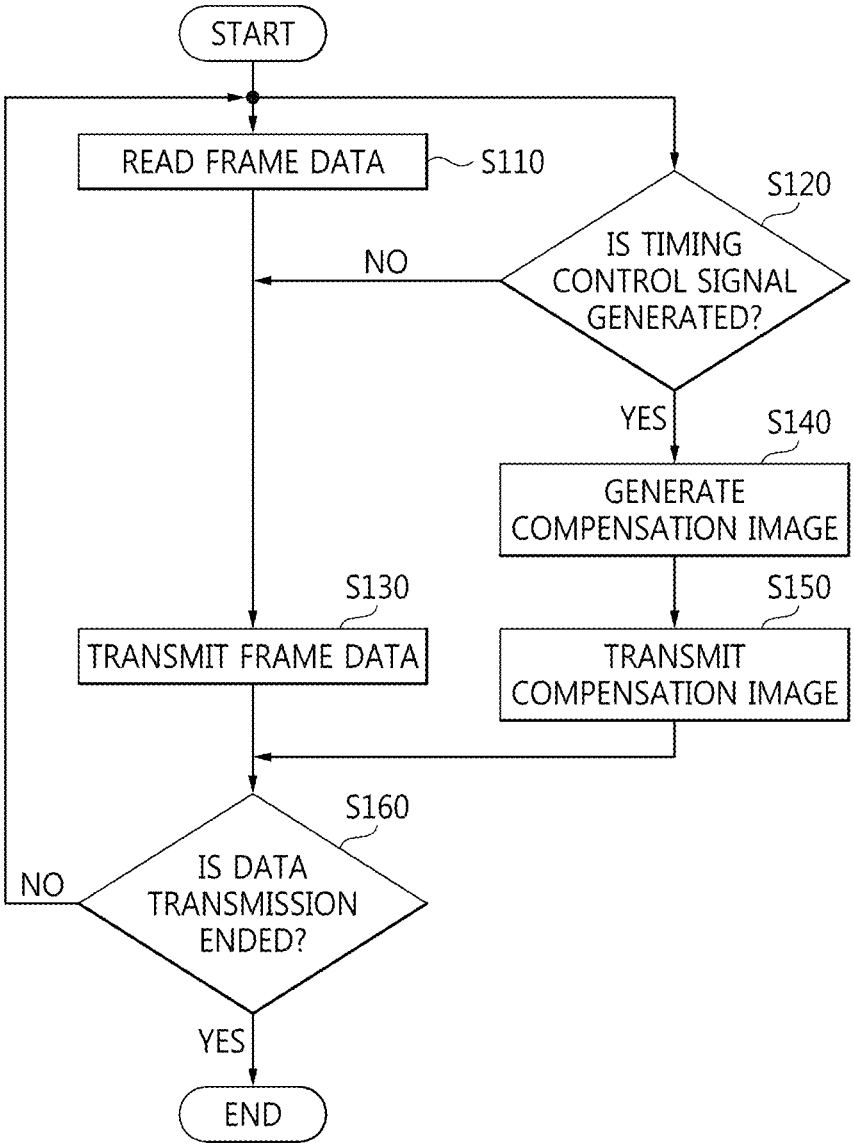
FIG. 8 is a flowchart of a method of operating a display controller according to example embodiments of the inventive concepts.
Figure 9:
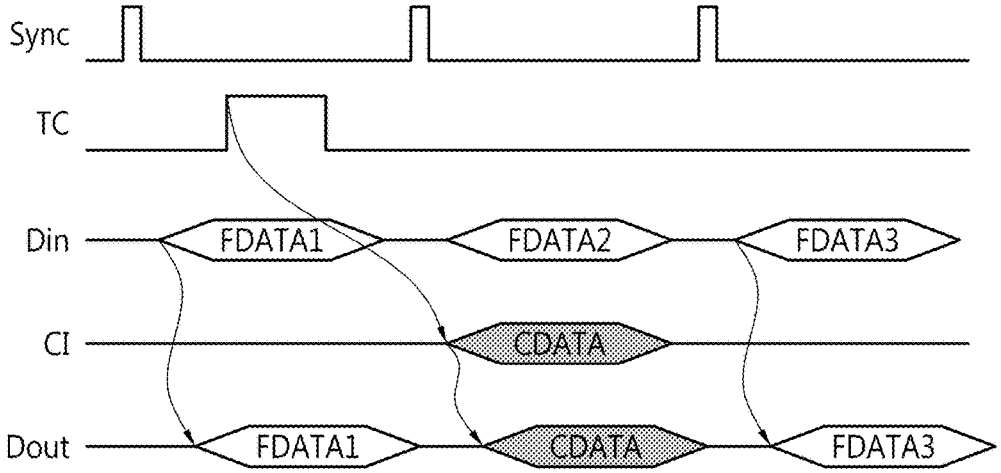
FIG. 9 is a schematic operational timing diagram illustrating an operation of a display controller according to example embodiments of the inventive concepts.

FIG. 8 is a flowchart of a method of operating a display controller according to example embodiments of the inventive concepts. FIG. 9 is a schematic operational timing diagram illustrating an operation of a display controller according to example embodiments of the inventive concepts. The method of FIG. 8 may be performed by the display controller 200*a*, 200*b*, 200*c*, or 200*d* of FIG. 3, 5, 6, or 7, respectively.

Referring to FIGS. 8 and 9, in operation S110, the display controller 200*a*, 200*b*, 200*c*, or 200*d* reads frame data FDATA via the data bus 181.

For example, the display controller 200*a*, 200*b*, 200*c*, or 200*d* may sequentially read first to third frame data FDATA according to a frame synchronization signal Sync. The reading of the first to third frame data FDATA may not be related to whether a timing control signal TC is generated or not.

In operation S120, the timing generator 260*a* or 260*b* may determine whether a compensation image CI is to be generated in parallel with the reading of the frame data FDATA, and generates the timing control signal TC when it is determined that the compensation image CI is to be generated.

In one or more example embodiments, the determining of whether the compensation image CI is to be generated at the current timing may include determining whether the same image data is repeatedly displayed a reference number of times or more among a plurality of frame data sequentially read via the data bus 181 as described above with reference to FIG. 6.

In one or more example embodiments, the determining of whether the compensation image CI is to be generated at the current timing may include counting the number of frames of the plurality of frame data sequentially read via the data bus 181, and comparing whether a result of counting the number of frames is equal to a preset frame skip rate as described above with reference to FIG. 5.

In operation S130, when the timing control signal is not generated, the read frame data FDATA may be transmitted as output image data Dout to the display device 20*a* or 20*b*.

For example, since the timing control signal TC is not generated during reading of first frame data FDATA1 in the embodiment of FIG. 9, in operation S130, the first frame data FDATA1 may be transmitted as the output image data Dout to the display device 20*a* or 20*b*.

In operation S140, when the timing control signal TC is generated, the compensation image generator 220*a* or 220*b* may generate the compensation image CI according to the timing control signal TC. In operation S150, the compensation image CI is transmitted as the output image data Dout to the display device 20*a* or 20*b* instead of the read frame data FDATA.

For example, in FIG. 9, the timing control signal TC is generated after the first frame data FDATA is read, and thus compensation data CDATA is generated. Thus, in operation S150, the compensation data CDATA may be transmitted as the output image data Dout to the display device 20*a* or 20*b* instead of the read second frame data FDATA2.

In operation S160, operations S110 to S150 described above may be repeatedly performed unless it is determined that data transmission will be ended since data is not transmitted any further to the display device 20*a* or 20*b* or since there is no data to be transmitted.

Figure 10:
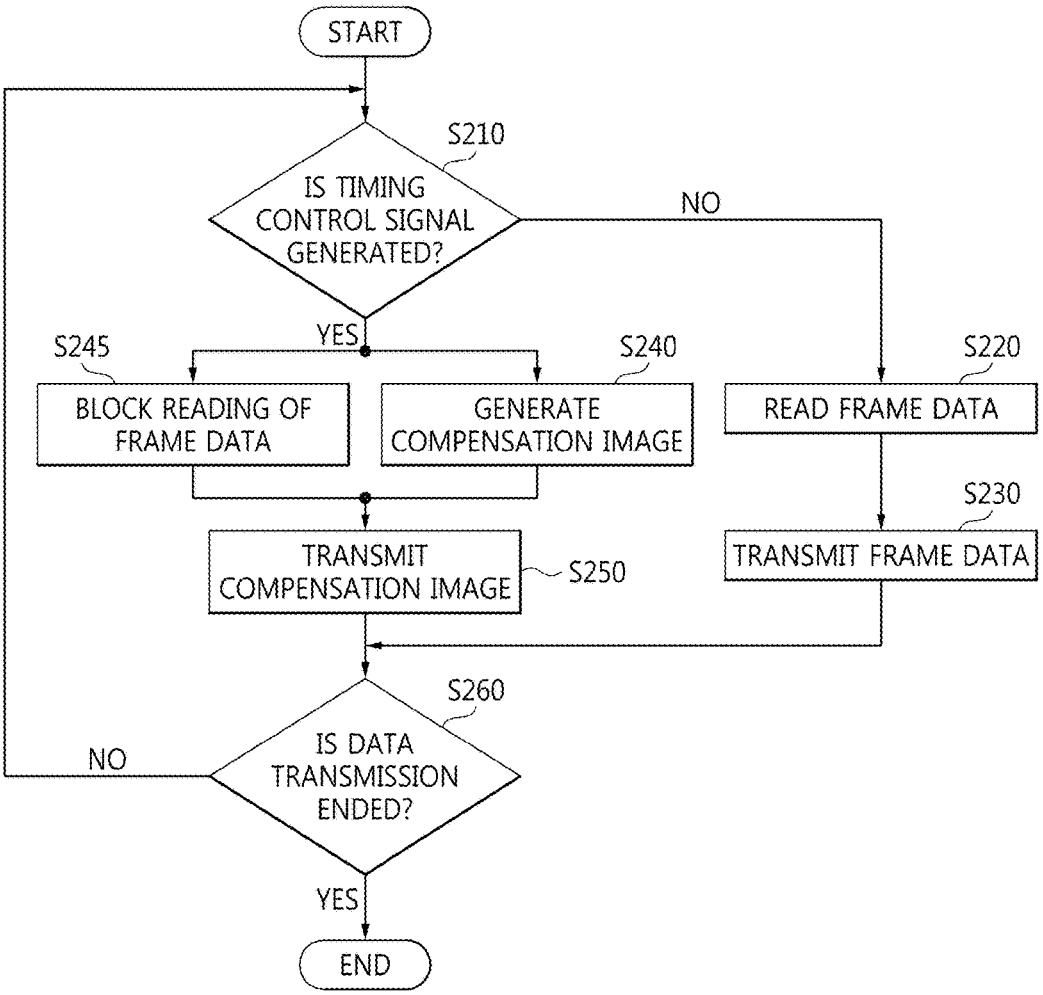
FIG. 10 is a flowchart of a method of operating a display controller according to other example embodiment of the inventive concepts.
Figure 11:
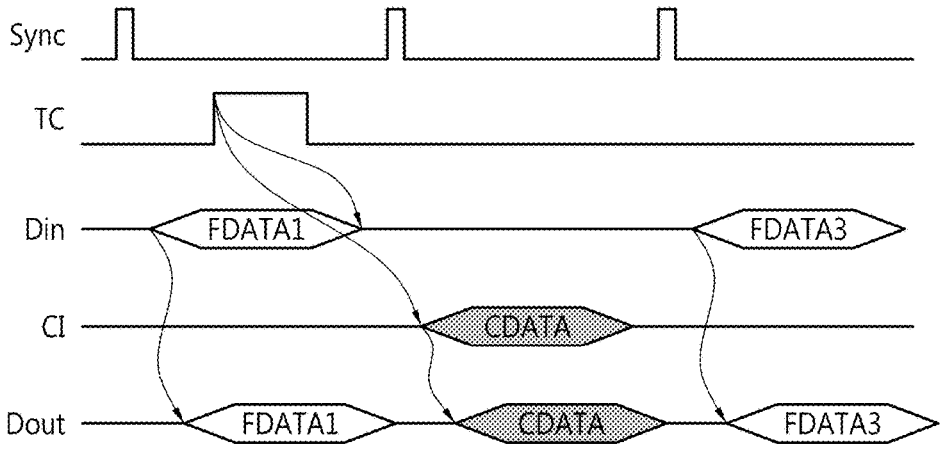
FIG. 11 is a schematic operational timing diagram illustrating an operation of a display controller according to other example embodiments of the inventive concepts.

FIG. 10 is a flowchart of a method of operating a display controller according to other example embodiments of the inventive concepts. FIG. 11 is a schematic operational timing diagram illustrating an operation of a display controller according to other example embodiments of the inventive concepts. The method of FIG. 10 may be performed by the display controller 200*a*, 200*b*, 200*c*, or 200*d* of FIG. 3, 5, 6, or 7, respectively.

Referring to FIGS. 10 and 11, in operation S210, the timing generator 260*a* or 260*b* of the display controller 200*a*, 200*b*, 200*c*, or 200*d* determines whether a compensation image CI is to be generated at a current timing, and generates a timing control signal TC at a timing when the compensation image CI is generated.

In one or more example embodiments, the determining whether the compensation image CI is to be generated at the current timing may include determining whether the same image data is repeatedly displayed a reference number of times or more among a plurality of frame data sequentially read via the data bus 181 as described above with reference to FIG. 6.

In one or more example embodiments, the determining whether the compensation image CI is to be generated at the current timing may include counting the number of frames of the plurality of frame data sequentially read via the data bus 181, and comparing whether a result of counting the number of frames is equal to a preset frame skip rate as described above with reference to FIG. 5.

In operation S220, when the timing control signal TC is not generated, the display controller 200*a*, 200*b*, 200*c*, or 200*d* reads new frame data FDATA according to a frame synchronization signal Sync. Then, in operation S230, the read frame data FDATA is transmitted to the display device 20*a* or 20*b*.

In operation S240, when the timing control signal TC is generated, the compensation image CI is generated, and in operation S245, reading of new frame data FDATA is blocked.

Next, in operation S250, the compensation image CI is transmitted as output image data Dout to the display device 20*a* or 20*b*.

For example, in the embodiment of FIG. 11, the display controller 200*a*, 200*b*, 200*c*, or 200*d* is to sequentially read first to third frame data FDATA1, FDATA2, and FDATA3 according to a frame synchronization signal Sync. However, after the first frame data FDATA1 is read, the timing control signal TC is generated and reading of the second frame data FDATA2 is blocked. Thus, the second frame data FDATA2 is not read, and only compensation data CDATA is generated and transmitted as output image data Dout to the display device 20*a* or 20*b* (operation S250).

As described above, in the embodiments of FIGS. 10 and 11, reading of new frame data is blocked at a point of time that the compensation image CI is transmitted. In operation S260, operations S210 to S250 described above may be repeatedly performed unless it is determined that data transmission will be ended since data is not transmitted any further to the display device 20*a* or 20*b* or since there is no data to be transmitted.

Figure 12:
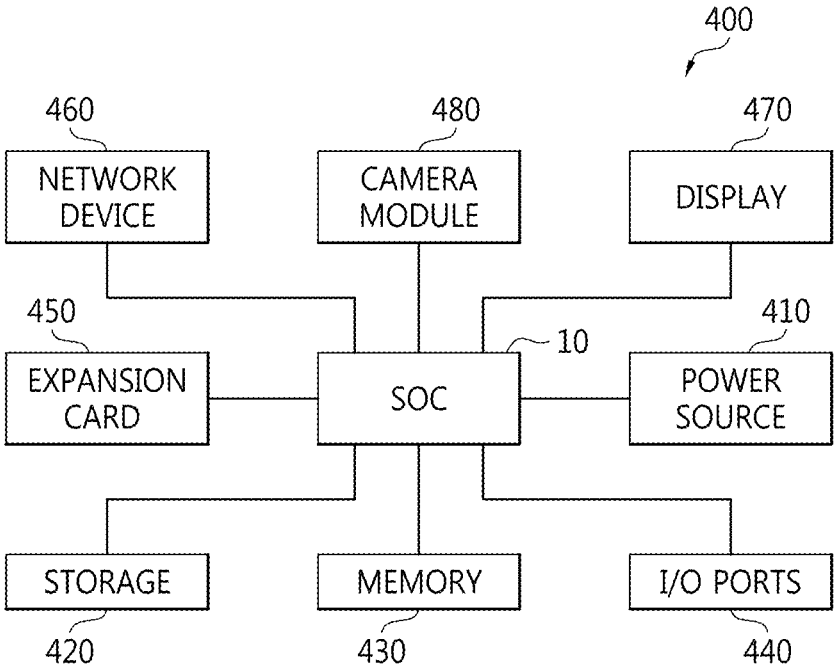
FIG. 12 is a block diagram of an electronic system including the SoC according to some example embodiments of the inventive concepts.

FIG. 12 is a block diagram of an electronic system including the SoC according to some example embodiments of the inventive concepts. Referring to FIG. 12, an electronic system 400 may be implemented as a PC, a data server, a laptop computer or a portable device. The portable device may be a cellular phone, a smart phone, a tablet personal computer (PC), a personal digital assistant (PDA), an enterprise digital assistant (EDA), a digital still camera, a digital video camera, a portable multimedia player (PMP), portable navigation device (PDN), a handheld game console, an e(electronic)-book device, etc.

The electronic system 400 includes the SoC 10, a power source 410, a storage device 420, a memory 430, I/O ports 440, an expansion card 450, a network device 460, and a display 470. The electronic system 400 may further include a camera module 480.

The SoC 10 may control the operation of at least one of the elements 410 through 480. The SoC 10 corresponds to the SoC 10 illustrated in FIGS. 1 and 2.

The power source 410 may supply an operating voltage to at least one of the elements 10, and 420 through 480. The storage device 420 may be implemented by a hard disk drive (HDD) or a solid state drive (SSD).

The memory 430 may be implemented by a volatile or non-volatile memory. A memory controller that controls a data access operation, e.g., a read operation, a write operation (or a program operation), or an erase operation, on the memory 430 may be integrated into or embedded in the SoC 10. Alternatively, the memory interface may be provided between the SoC 10 and the memory 430.

The I/O ports 440 are ports that may receive data transmitted to the electronic system 400 or transmit data from the electronic system 400 to an external device. For instance, the I/O ports 440 may include a port connecting with a pointing device such as a computer mouse, a port connecting with a printer, and a port connecting with a USB drive.

The expansion card 450 may be implemented as a secure digital (SD) card or a multimedia card (MMC). The expansion card 450 may be a subscriber identity module (SIM) card or a universal SIM (USIM) card.

The network device 460 may enable the electronic system 400 to be connected with a wired or wireless network. The display 470 may display data output from the storage device 420, the memory 430, the I/O ports 440, the expansion card 450, or the network device 460.

The camera module 480 may convert optical images into electrical images. Accordingly, the electrical images output from the camera module 480 may be stored in the storage module 420, the memory 430, or the expansion card 450. Also, the electrical images output from the camera module 480 may be displayed through the display 470.

The example embodiments of the inventive concepts can also be embodied as computer-readable codes on a computer-readable medium. The computer-readable recording medium is any data storage device that can store data as a program which can be thereafter read by a computer system. Examples of the computer-readable recording medium include read-only memory (ROM), random-access memory (RAM), CD-ROMs, magnetic tapes, floppy disks, and optical data storage devices.

The computer-readable recording medium can also be distributed over network coupled computer systems so that the computer-readable code is stored and executed in a distributed fashion. Also, functional programs, codes, and code segments to accomplish the example embodiments of the inventive concepts can be easily construed by programmers.

As described above, according to example embodiments of the inventive concepts, when the same image data is repeatedly transmitted to a display device, a compensation image may be inserted into the same image data and the same image data may be then transmitted, thereby reducing an after-image caused when the same image is repeatedly displayed.

Accordingly, display noise may be reduced and thus the quality of a display device and the performance of a device including the display device may be improved.

While the inventive concepts have been particularly shown and described with reference to example embodiments thereof, it will be understood that various changes in form and details may be made therein without departing from the spirit and scope of the following claims.

What is claimed is:

1. A display controller for controlling a display device, the display controller comprising:

image processing logic configured to sequentially read a plurality of input image data via a data bus and process the plurality of input image data;

a timing generator configured to output a timing control signal;

a compensation image generator configured to generate and output a compensation image according to the timing control signal;

a data interface configured to transmit one of the compensation image and the plurality of input image data to the display device based on the timing control signal; and a register configured to store a frame count enable signal and a frame skip rate, wherein the timing generator includes a frame counter configured to count a number of frames of the plurality of input image data and output the timing control signal if a result of counting the number of frames is equal to the frame skip rate in a state in which the frame count enable signal is enabled.

2. The display controller of claim 1, further comprising:

a register configured to store a mode set signal and a compensation image transmission period, wherein the timing generator is configured to output the timing control signal according to the mode set signal and the compensation image transmission period.

3. The display controller of claim 2, wherein the timing generator is configured to generate the timing control signal at a random point of time within the compensation image transmission period.

4. The display controller of claim 1, further comprising:

an image comparator configured to determine whether same image data is repeatedly displayed a reference number of times or more from among the plurality of input image data.

5. The display controller of claim 4, wherein the timing generator is configured to output the timing control signal based on whether the same image data is repeatedly displayed the reference number of times or more.

6. The display controller of claim 4, wherein the reference number is a desired number of frames or a desired time.

7. The display controller of claim 4, wherein each of the plurality of input image data is frame data, and the image comparator is configured to compare current frame data and previous frame data to determine whether the current frame data and the previous frame data are the same image data.

8. The display controller of claim 4, wherein each of the plurality of input image data is frame data, and the image comparator is configured to compare an address of current frame data and an address of previous frame data to determine whether the current frame data and the previous frame data are the same image data.

9. The display controller of claim 1, wherein the timing generator is enabled based on state information received from the display device.

10. The display controller of claim 9, wherein the state information comprises at least one of temperature information and brightness information of the display device.

11. The display controller of claim 1, wherein the compensation image comprises at least one of data stored beforehand, random data that is not related to the plurality of input image data, and complementary data that is complementary to the input image data.

12. The display controller of claim 1, wherein the compensation image is data having a desired color value.

13. The display controller of claim 1, wherein the image processing logic does not read at least one segment of input image data according to the timing control signal.

14. A display controller of a display device, the display controller comprising:

a timing generator configured to output a control signal based on information from a register;

a compensation image generator configured to output a compensation image based on the control signal; and a selector configured to select one of the compensation image and a plurality of frame data based on the control signal, wherein the selector is configured to select the plurality of frame data if the control signal is at a first logic value, the selector is configured to select the compensation image if the control signal is at a second logic value, opposite from the first logic value, the information includes a desired frame skip rate, and the timing generator includes a counter configured to count a number of frames of the plurality of frame data and output the control signal at the second logic value if the counted number of frames is equal to the desired frame skip rate.

* * * * *